United States Patent [19]

Pugh

[11] Patent Number: 4,789,045

[45] Date of Patent: Dec. 6, 1988

[54] SWING ROPE

[75] Inventor: Billy G. Pugh, Corpus Christi, Tex.

[73] Assignee: Billy Pugh Co., Inc., Corpus Christi, Tex.

[21] Appl. No.: 48,681

[22] Filed: May 12, 1987

[51] Int. Cl.[4] ..... E06C 1/56

[52] U.S. Cl. ..... 182/190; 57/207; 182/100; 294/74; 114/362; 441/80

[58] Field of Search ..... 57/207, 211, 217, 221, 57/223, 230, 232, 234, 242; 87/1, 5–7, 13; 114/362; 182/100, 190, 196–198; 272/85; 294/74, 77, 140; 428/246, 252, 260, 261, 361, 364, 372, 375, 377, 403, 407; 441/80, 83, 84, 136

[56] References Cited

U.S. PATENT DOCUMENTS

| | | | |
|---|---|---|---|
| 716,109 | 12/1902 | Rodde | 182/190 X |
| 2,561,487 | 7/1951 | Bailhe | 294/74 X |
| 2,799,133 | 5/1951 | Rose | 57/140 |
| 2,974,559 | 3/1961 | Coggi | 87/1 |
| 3,043,086 | 7/1962 | Hood | 57/211 |
| 3,137,990 | 6/1964 | Carranza | 57/242 |
| 3,405,516 | 10/1968 | Laureti | 57/211 |
| 3,716,982 | 2/1973 | Morohashi et al. | 57/145 |
| 3,960,050 | 6/1976 | Eisler | 87/1 |
| 4,171,840 | 10/1979 | Berzenye | 294/74 |
| 4,422,286 | 12/1983 | Simpson et al. | 57/217 X |
| 4,557,442 | 12/1985 | Krezak et al. | 182/190 X |
| 4,593,599 | 6/1986 | Yeardley | 87/6 |
| 4,640,179 | 2/1987 | Cameron | 57/232 X |

*Primary Examiner*—Johnny D. Cherry

*Attorney, Agent, or Firm*—Stevens, Davis, Miller & Mosher

[57] ABSTRACT

Swing rope constructed of successive layers of polyurethane, fiberglass resin, polypropylene rope, a second fiberglass resin and an abrasive grit. The swing rope may be used to transport crew members of an offshore rig to or from a waiting boat. A second embodiment relates to a non-slip surface applied to a rescue sling.

12 Claims, 2 Drawing Sheets

SWING ROPE

BACKGROUND OF THE INVENTION

1. Field of the Invention

This invention relates to a swing rope having multiple coatings which provide an all weather construction and a non-slip grip. The swing rope may be safely used to carry crew workers to or from an oil rig or to and from a waiting barge or boat. A second embodiment relates to a non-slip grip applied to a rescue sling.

2. Description of the Prior Art

Swing ropes are familiar to most children and adults. Typically such a device is fixed to a tree branch and is suspended above the ground or over a body of water. The swing rope usually has a dangling free end, or the free end may be fixed to a tire or other device in which a user may sit or stand. Today swing ropes are used on many offshore oil rigs to efficiently convey crew workers from the oil rig platform to or from a waiting barge or boat. Unfortunately, swing ropes employed by crews consist of an untreated length of rope with a series of overhand knots. Untreated ropes are especially slippery in the offshore oil rig environment, and the use of such ropes may imperil the crew. Additionally, such ropes have a limited useful life due to weathering, and chafing. Those in the industry are aware of these deficiencies and have indicated a need for a safe, non-slip swing rope which is chafe and weather-resistant. The present invention satisfies this need.

SUMMARY OF THE INVENTION

The swing rope is constructed of successive layers of materials. The layered configuration provides an all-weather, non-slip swing rope.

More particularly, the invention relates to a swing rope comprising a bitter end, a second end, a first knot located above the bitter end, a last knot located above the first knot and below the second end, a polyurethane coat about the entirety of the rope, a first fiberglass resin coat about the rope between the knots, and about a section of said rope immediately above the last knot, a polypropylene rope spirally wound about the first fiberglass resin coat, a second fiberglass resin coat about the polypropylene rope and an abrasive grit on the second fiberglass resin coat, the swing rope being adapted for used as an all-weather swing rope when the second end is suspended from a fixed structure.

The swing rope may be prepared by a method which comprises forming a plurality of spaced knots in a rope having a bitter end and a second end so that a first knot is located above the bitter end, and a last knot is located above the first knot and below the second end, coating the knotted rope from a polyurethane solution; drying the dipped rope; applying a first fiberglass resin coat about the rope between the knots, and about a section of the rope immediately above the last knot; spirally winding a polypropylene rope about the first fiberglass resin coat; applying a second fiberglass resin coat about the polypropylene rope; and applying a fine grit upon the second fiberglass resin coat while the second resin is wet and allowing the second resin coat to dry whereby the grit is adhered to the resin so that an all-weather, non-slip rope is formed.

BRIEF DESCRIPTION OF THE DRAWINGS

The features of the present invention will be described in connection with the accompanying drawings.

The features described in the drawings relating to the instant invention are illustrative and are not considered to limit the present invention. The drawings consist of figures which are not drawn to scale.

DESCRIPTION OF THE PREFERRED EMBODIMENTS

Figure 1:
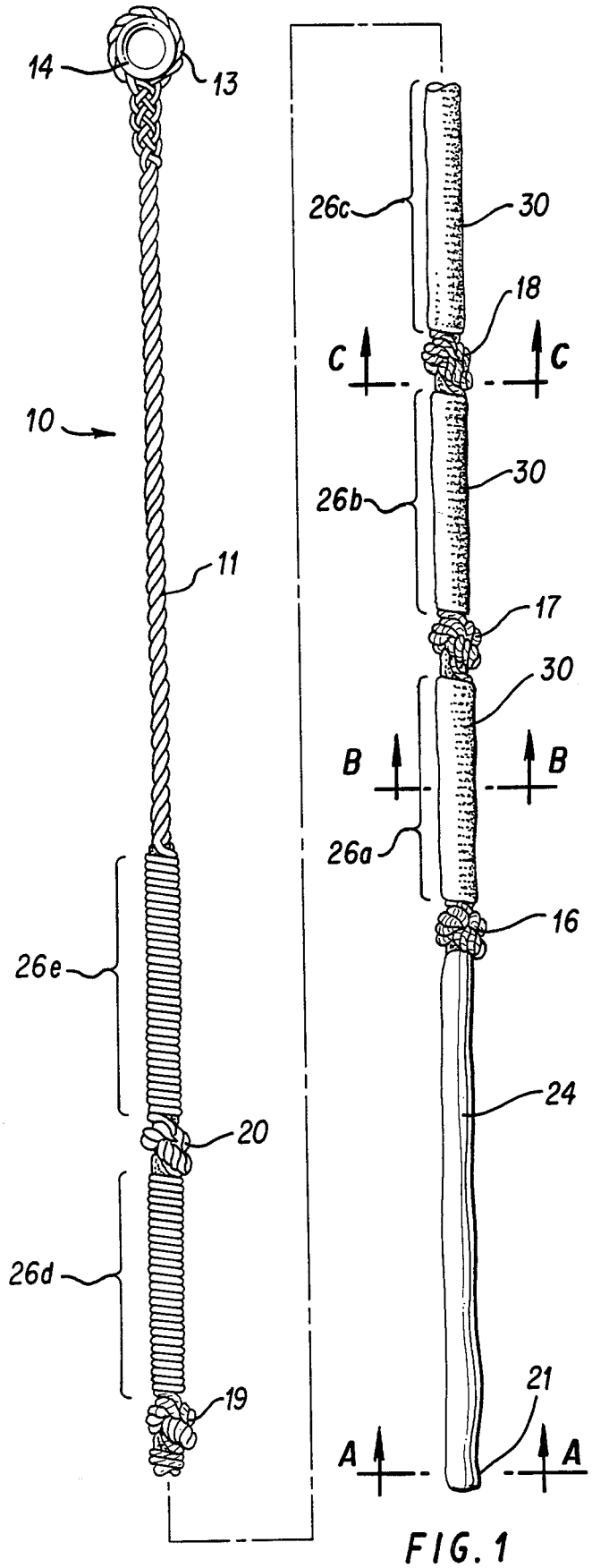
FIG. 1 part in section shows the swing rope of this invention.

With reference to FIG. 1, the starting material or rope core 11 of the swing rope 10 is a Coast Guard accepted ladder rope composed of three strands 15 of polyester. The polyester rope core 11 generally has a right handed twist and a diameter of about $\frac{3}{4}$ of an inch. The core of each polyester strand has an orange polypropylene tracer 12. On decay or failure of the polyester strands, the orange core becomes visible indicating that the rope should be disposed of. A ladder rope having polypropylene tracers can be purchased from DuPont.

The top of the rope has an eye or an eye splice 13. The eye splice is provided with a steel thimble 14. Structures 13 and 14 are conventional structures known to those skilled in the art of rope making. An eye and thimble are shown and described in U.S. Pat. No. 2,799,133 to Rose which is hereby incorporated herein by reference. After formation of the eye splice 13 and placement of the thimble 14, a first knot 16 is made about four feet from the bitter end 21 of the rope. This is an overhand knot which is tightened by pulling the polyester rope taut. The knot may be merely hand tightened. After knot 16 is set, successive overhand knots 17, 18, 19 and 20 may be made in the rope, and pulled taut as disclosed above. Each successive knot is positioned about two feet above its neighbor, so that knot 17 is positioned about two feet from knot 16, knot 18 is positioned about four feet from knot 16, and knot 19 is positioned about six feet from knot 16. A typical swing rope may have approximately five knots and may be of a length of about twenty-five feet. The fifth or last knot in such a rope may therefore be positioned about thirteen feet below the eye splice 13 and eight feet above knot 16, and twelve feet above the bitter end. Of course, such ropes are not limited to lengths of twenty-five feet, and the number of overhand knots as well as the spacing of the knots may be increased or decreased depending on user's or purchaser's preference. Such a rope as described hereafter may exclude knots 16 to 20 and may be merely coated with successive layers of material.

The knots function as safety valves or more precisely as secondary gripping means. Additionally, the knots may be used as a step or landing for a user's foot or feet.

Knot 16 shown in FIG. 1, as described above, is positioned about four feet up from bitter end 21. Experience has shown that the bitter end 21 of the rope may be subject to uncontrolled swinging or oscillations and may become fouled with ground equipment or equipment above or below sea level. Positioning a knot at the bitter end only exacerbates this problem.

After formation of the overhand knots 16, 17, 18, 19 and 20, the bitter end 21 is secured by sewing the bitter end 21 with waxed nylon thread 22 and a sail needle. Waxing the nylon thread with beeswax facilitates therading the nylon through strands 15 of the core rope 11 or between the lays of the rope strands 15. After threading, nylon thread 22 is wrapped around the bitter end 21 and the free end of the nylon thread 22 is secured by tucking it under one of the lays of the core rope 11. A second optional nylon sewing and wrapping may be made approximately four inches above the bitter end 21.

With the eye splice 13, thimble 14, knots 16–20 and bitter end 21 secured, the rope is dipped into a polyurethane liquid dip to coat the rope. The rope is dipped long enough so that a polyurethane coat 24 may be formed about the entirety of the rope. Thereafter the rope is removed from the dip, and hung to dry at 80° F. for about 6 hours. The polyurethane coat 24, when dry, is between 2 and 4 mils thick, and protects the strands of the rope from ultraviolet radiation of the sun and from abrasion. After polyurethane coat 24 is dried, a first fiberglass resin coat 25 is applied about the rope. More specifically the fiberglass resin is brushed or sprayed about rope sections 26*a, b, c* and *d* and on a section of the rope designated 26*e* above knot 20. The knots are not covered with the resin. The fiberglass resin coat 25 extends about two feet above knot 20 on section 26*e*. After the fiberglass resin coat is applied and while still wet, polypropylene rope 28 having a diameter of about 5/16 of an inch is spirally wound about rope sections 26*a, b, c, d,* and *e* which are covered with the wet fiberglass resin.

The polypropylene 28 rope is spirally wound about the resin coat 25 and the windings are made as tight about the rope as possible with successive spirals being in contact with one another. The spiral wrapping is accomplished with an overhead wrapping machine. The machine is positioned above the rope and travels on circular track, revolving above the rope while feeding out polypropylene rope from a supply spool. A workman positions the polypropylene and ensures that tight spirals are formed about the polyester rope. Before starting the spirals on section 26*e* of the rope a free end of the polypropylene rope is passed through resin coat 25, the polyurethane coat 24, and through a lay of the polyester rope. Thereafter spiral winding is commenced. When the spirals reach the top of knot 20, a small amount of polypropylene rope is played out, and the played out end is secured by weaving it through the interlaced sections of knot 20. Leftover polypropylene rope protruding through the knot is then cut flush with knot 20. After securing polypropylene rope 28 to knot 20, the end of the polypropylene rope dangling from the overhead machine is secured under a lay of the polyester rope just below knot 20 and once again the polypropylene rope is spirally wound about the polyester rope. On encountering knot 19 polypropylene rope 28 is again played out and cut from the machine, and the free end is secured between the interlaces of knot 19 in a manner similar to that described above. Spiral winding of polypropylene rope continues until the entire fiberglass resin coat 25 is covered with polypropylene rope 28. Polypropylene is one desirably medium to which fiberglass resin forms a particularly strong bond.

After formation of the polypropylene spirals, a second fiberglass resin coat 29 is brushed or sprayed onto the polypropylene rope. About a pint of fiber glass resin is used for double applications of resin on a rope of about twenty-five feet. An abrasive grit 30 is then applied to the wet resin coat 29.

Grit 30 is blasting grit, which may be the residue of steel slag, or a grinding pumice stone or sand. A particularly useful grit is sold by the Clemtrix Company, a corporation of Texas, under the designation BG #6. This is an extra fine sample of steel slag blasting grit. About 0.25 pounds of blasting grit should be applied to the wet resin 29 per twenty five foot. Of course, the grit is only applied on portions of the rope having the wet resin. Additional grit will make the rope stiff. When fiberglass coats 25 and 29 dry, the formed swing rope 10 is an integral structure, highly resistant to weathering, peeling, and chafing, and has a non-slip grip.

Figure 6:
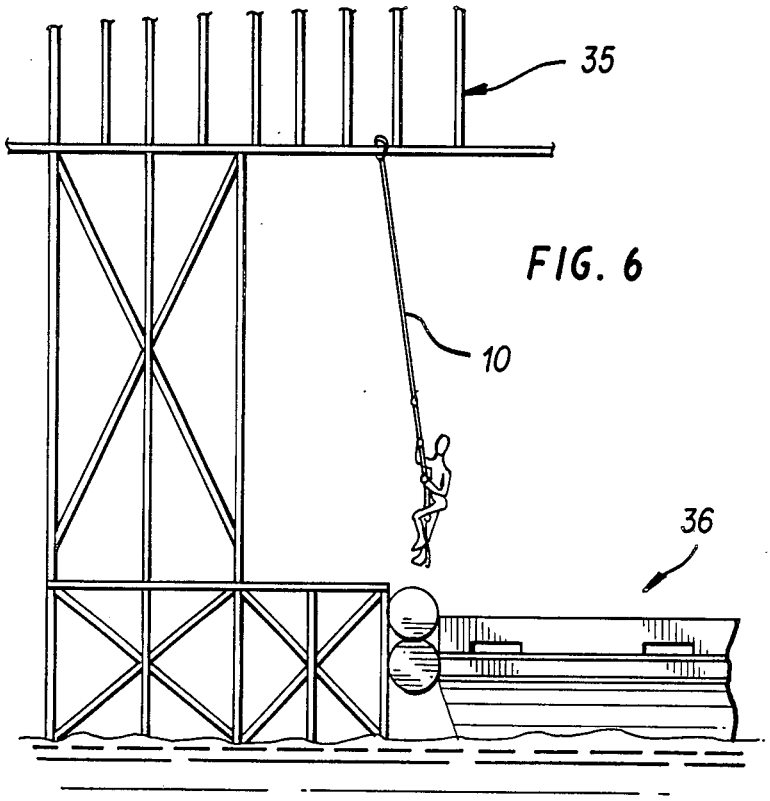
FIG. 6 shows the swing rope in use.

In use the eye and thimble of the rope may be secured to a hook on a stationary structure such as an offshore oil rig 35 or other fixed structure, as shown in FIG. 6. An oil rig worker is then able to safely alight from the platform onto a waiting barge or boat 36 by hanging onto the swing rope 10 and swinging from the platform to the boat.

Figure 2:
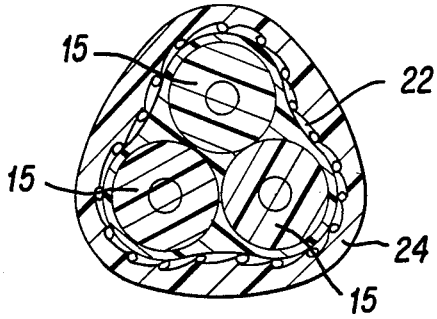
FIG. 2 is a bottom view of the swing rope on line a—a.
Figure 3:
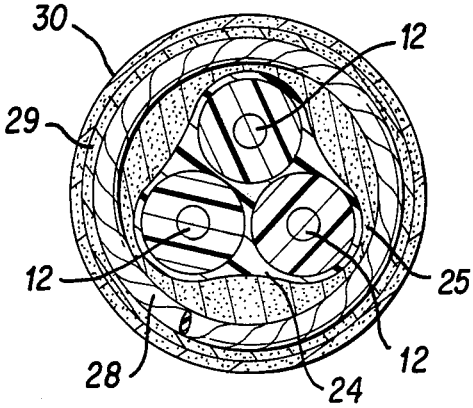
FIG. 3 is a cross-section of the swing rope on line b—b.
Figure 4:
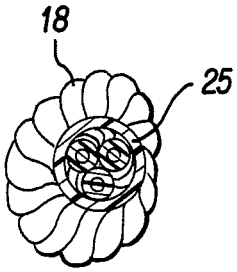
FIG. 4 is a cross-section of the swing rope on line c—c.
Figure 5:
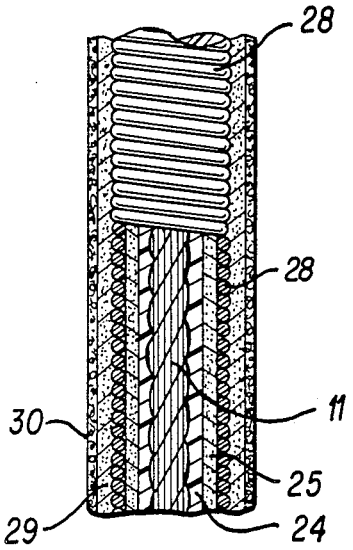
FIG. 5 is an elevational view, partly in section, of a section of the swing rope between knots.

FIG. 2 is a bottom view of the swing rope showing the bitter end sewn and wrapped with nylon thread and having a polyurethane coat. FIG. 3 is a cross-sectional view taken between the first knot 16 and knot 17 showing the polyester Coast Guard approved rope 11 used as the center of the swing rope 10. Shown successively from the polyester rope to the outer layers is a polyurethane coat 24, a first fiberglass coat 25, polypropylene rope 28, a second fiberglass coat 29, and abrasive grit 30. FIG. 4 shows a cross section of knot 18, which is similar to the cross sections of knots 16, 17, 19 and 20. The cross section shows the interlaced sections of the polyester rope, coated with polyurethane coating 24.

The diameter of the finished swing rope is about $1\frac{1}{4}$ inches. This diameter comfortably fits the hand of an average adult, so that not only the fingers of an individual hold onto the rope, but the palm of the hand is able to grip the rope as well.

As disclosed above the swing rope may be fabricated without knots. In this case the polyester rope will be given an eye splice and a thimble, and the bitter end will be secured with nylon as before. Thereafter the entire rope will be dipped into the polyurethane bath and will be allowed to dry as discussed. Thereafter fiberglass resin will be brushed or sprayed onto the rope so that the portion of the rope from a distance approximately six feet from the eye splice to about four feet above the bitter end is covered with the resin. Polypropylene rope will be spirally wound about the fiberglass resin coat as discussed above. In this case, however, both ends of the polypropylene rope may be secured by tucking it under the lays of the polyester rope, instead of securing at least one of the ends to a knot. Thereafter, a second coat of fiberglass resin will be applied about the spirally wound polypropylene rope and the abrasive grit discussed above will be applied to the rope wet resin.

In a second embodiment, an abrasive coat is applied to a helicopter rescue sling. The Coast Guard and Navy have previously abandoned the use of rescue slings because a water victim has a tendency to slip through the vinyl coated sling. Slipping or falling out of the sling is particularly common when a victim's back, instead of his abdomen or chest, engages the inner back side of the sling. Generally, when using the sling multiple rescue attempts must be made. In poor weather, and high seas, a second rescue attempt may be hazardous to the pilot and crew of a rescue plane or helicopter. Additionally, the victim may succumb to drowning or hypothermia before being pulled from the water. By applying an abrasive coat or gripping means to the victim-contacting portion of the sling, victim loss may be prevented.

Figure 7:
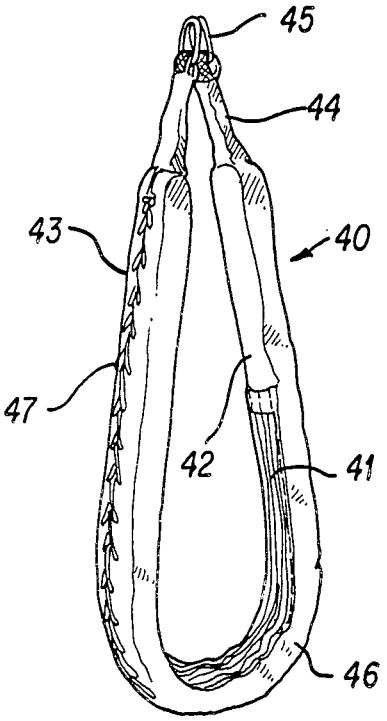
FIG. 7 shows a second embodiment of the invention.
Figure 8:
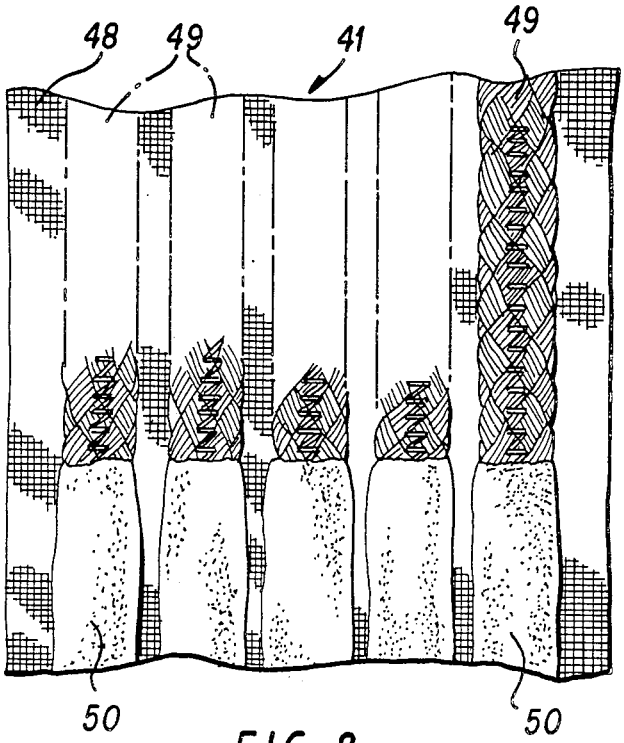
FIG. 8 is an elevational view of the gripping means on the device of FIG. 7.

A rescue sling 40 having gripping means 41 is shown in FIG. 7. Generally, the sling 40 has an inner surface or side 42 and an outer surface or side 43. The sling 40 is comprised of a double layer of four inch nylon belting 44 having stainless steel pickup rings 45 attached to opposing ends of the nylon belting 44. Between the ends and about the belting is secured a flotation material (not shown). An outer jacket of a colored vinyl 46 surrounds the flotation material. The vinyl jacket may include laces 47 on the outer surface 43 of the sling.

In a preferred embodiment the gripping means 41 includes an elongated four inch nylon support 48 having attached thereto at least one elongated polypropylene swatch 49. The nylon support is generally shorter than the rescue sling. The polypropylene swatch may be a flat braided polypropylene rope having a length equal to that of the nylon support 48. The width of the swatch may be about one quarter of an inch or more. Preferably, the nylon support has attached thereto a plurality of polypropylene braided ropes, each rope being one-quarter to one-half inch thick. More preferably five elongated swatches of polypropylene are secured in a generally parallel relationship on the outside surface of nylon support 48. The swatches may be sewn to the support. To at least one section of each swatch 49 is applied a fiberglass resin coat (not shown). While the resin is still wet it is covered with an abrasive grit 50 which may be GB #6. As the resin dries the grit adheres to the swatch forming a non-slip surface. The grit-coated resin sections of the swatches are usually between four and five inches long and are spaced on each swatch at intervals of between about five and six inches. The free surface of the nylon support may be secured to the inner surface of the rescue sling by sewing. As may be appreciated, the polypropylene swatches may be sewn directly to the jacket of the sling and the nylon support may be dispensed with. This construction allows a rescue team to use a rescue sling in confidence to retrieve a water victim. A water victim, no matter how positioned in the sling, will generally be secured without slipping by virtue of gripping means 41.

The gripping means 41 disclosed herein may also be used as a gripping surface for an American Red Cross approved rescue tube, rescue bouy, or torpedo bouy. Such equipment is shown on the cover of the America Red Cross Lifesaving Training Manual, 1983 at pages 7-4 and at pages 7-5.

While specific embodiments of the invention have been set forth and described, it should be apparent that modifications may be made thereto without departing from the spirit and scope of the invention. Accordingly, the invention is not limited by the foregoing description, but is only limited by the scope of the claims appended hereto.

What is claimed is:

1. A swing rope comprising:

a bitter end;

a second end;

a first knot located above said bitter end, a last knot located above said first knot and below said second end;

a polyurethane coat about the entirety of said rope;

a first fiberglass resin coat about the rope between said knots and about a section of said rope immediately above said last knot;

a polypropylene rope spirally wound about said first fiberglass resin coat;

a second fiberglass resin coat about said polypropylene rope and an abrasive grit on said second coat of fiberglass resin coat, said swing rope being adapted for use as an all-weather transporting device when said second end is suspended from a fixed structure.

2. The swing rope of claim 1, wherein said second end includes an eye splice and thimble.

3. The swing rope of claim 2, wherein said bitter end is secured by sewing said end with nylon thread.

4. The swing rope of claim 1, wherein said bitter end is secured by sewing said end with nylon thread.

5. The swing rope of claim 1, wherein said rope is comprised of strands of polyester and each strand has a colored polypropylene tracer.

6. The swing rope of claim 1, wherein said grit is fine steel slag.

7. The swing rope of claim 1, further comprising one or more knots positioned between said first and last knots.

8. A method of making a swing rope which comprises:

forming a plurality of spaced knots in a rope having a bitter end and a second end so that a first knot is located above said bitter end, and a last knot is located above said first knot and below said second end;

coating said knotted rope with a polyurethane solution;

drying said rope;

applying a first fiberglass resin coat about the rope between said knots, and about a section of said rope immediately above said last knot;

spirally winding a polypropylene rope about said first fiberglass resin coat;

applying a second fiberglass resin coat about said polypropylene rope; and applying a fine grit upon said second fiberglass resin coat while said second resin coat is wet and allowing said second resin coat to dry whereby said grit is adhered to said resin so that an all-weather, non-slip rope is formed.

9. A swing rope having a rope core, an eye splice secured to a first end of the rope core, a thimble in the eye splice, and a bitter end at a second end of the rope, further comprising, a first fiberglass resin coat about the rope core between said two ends;

a spirally wound polypropylene rope about said first fiberglass resin coat;

a second fiberglass resin coat about said spirally wound rope; and an abrasive grit applied about said second fiberglass resin coat.

10. The swing rope according to claim 9, wherein said rope core comprises three strands of polyester.

11. The swing rope according to claim 10, wherein the polyester strands have a tracer core.

12. The swing rope according to claim 9, wherein the spirally wound rope is polypropylene rope and said polypropylene rope has a diameter of about 5/16 of an inch, and said rope core has a diameter of about ¾ of an inch.

* * * * *